United States Patent [19]

Miley

[11] Patent Number: 4,751,896

[45] Date of Patent: Jun. 21, 1988

[54] ADULT AND CHILD TETHER ASSEMBLY

[76] Inventor: Willa F. Miley, P.O. Box 642, Belle, W. Va. 25015

[21] Appl. No.: 754,130

[22] Filed: Jul. 12, 1985

[51] Int. Cl.[4] ..... A62B 35/00

[52] U.S. Cl. ..... 119/96

[58] Field of Search ..... 128/133, 134; 119/96, 119/106, 109; 272/143; 2/170, 338, DIG. 6

[56] References Cited

U.S. PATENT DOCUMENTS

| | | | |
|---|---|---|---|
| 2,994,300 | 8/1961 | Grahling | 119/96 |
| 3,088,438 | 5/1963 | Oliphant | 119/96 |
| 4,337,938 | 7/1982 | Rodriguez | 272/143 X |
| 4,544,155 | 10/1985 | Wallenbrock et al. | 272/143 X |

FOREIGN PATENT DOCUMENTS

| | | | |
|---|---|---|---|
| 1013506 | 12/1965 | United Kingdom | 119/96 |

*Primary Examiner*—Richard T. Stouffer
*Attorney, Agent, or Firm*—William F. Frank

[57] ABSTRACT

The present invention comprises a pair of cuff assemblies for the adult and child and an interconnecting strap assembly, all three assemblies being made of the same material which is an extensible fabric band similar to the extensible material used in waist bands for women's skirts and slacks. Other than size, the two cuff assemblies are identical in structure. Loop and pile locking material is used for setting the correct length of each cuff and is placed on the interior of the cuff of that when the cuff is in place, the loop and pile locking material closure is inaccessible. The use of the loop and pile locking material also provides an inextensible portion of the cuff which will prevent the cuff elongated when in place to slip the hand of the wearer out of the cuff.

2 Claims, 1 Drawing Sheet

ADULT AND CHILD TETHER ASSEMBLY

FIELD OF INVENTION

The present invention is in the field of child safety and security. More specifically, the present invention provides the means to assist an adult in maintaining control of a small child while they are walking.

BACKGROUND OF THE INVENTION

One of the basic problems adults experience while with the small children is the tendency of the child to not wish to stay along side the parent but to move about as his curiosity arouses his interest. In shopping malls, supermarkets and similar, and out on the streets the problem of keeping contact with the child who is too large to carry and too small and young to be trusted on his own to conform to the adults desires in the presence of large numbers of strangers. The rash of incidents involving the disappearances of children from shopping malls and the like makes it of paramount importance to have the means to provide freedom for a child to walk with the adult and at the same time keep some control over the child's whereabouts.

There are now some such devices such as the small harness which fits over the shoulders and around the chest and is attached to one or more straps, either as a simple strap or a times when walking with a dog. There are also known devices which strap around the wrist of the child and adult respectively and which have a cord interconnecting the two straps encircling the respective wrists. These prior device generally comprise of a leather strap or leather-like strap for each waist complete with buckle on one end and a perforated portion on the other end of the buckle which is inserted after the strap is adjusted to fit the particular wrist. Generally speaking, each of the straps carries a d-ring mounted near the buckle, and the interconnecting cord generally has a snap at each end. The interconnecting strap is usually of a special material and in prior devices a helically wound cord was employed. This necessitated the use of swiveled hooks to accommodate the rotation of the interconnecting cord as it is elongated and returned to its coiled condition. The prior art envisioned a quasi-security arrangement for the strap wich was to encircle the child's wrist. The principal disadvantage in the prior devices is that the strap for the child's wrist can be properly fixed only with difficulty so that it encircles with the child's wrist sufficiently closely that the hand cannot be pulled through it but not so tightly as to cause discomfort to the child. The strap also is uncomfortable due to the general stiffness of the materials from which it was made if it was to have any strength and support to it.

SUMMARY OF THE PRESENT INVENTION

The present invention comprises a pair of cuff assemblies for the adult and child and an interconnecting strap assembly, all three assemblies being made of the same material which is an extensible fabric band similar to the extensible material used in waste bands for women's skirts and slacks. Other than size, the two cuff assemblies are identical in structure. Loop and pile locking material is used for setting the correct length of each cuff and is placed on the interior of the cuff so that when the cuff is in place, the closure is inaccessible. The use of the this locking material also provides an inextensible portion of the cuff which will prevent the cuff elongated when in place to slip the hand of the wearer out of the cuff.

BRIEF DESCRIPTION OF THE DRAWINGS

An illustrative embodiment of the present invention may be seen in the accompanying drawings and should not be considered limiting as to the scope of the invention.

DETAILED DESCRIPTION OF THE PRESENT INVENTION

Figure 1:
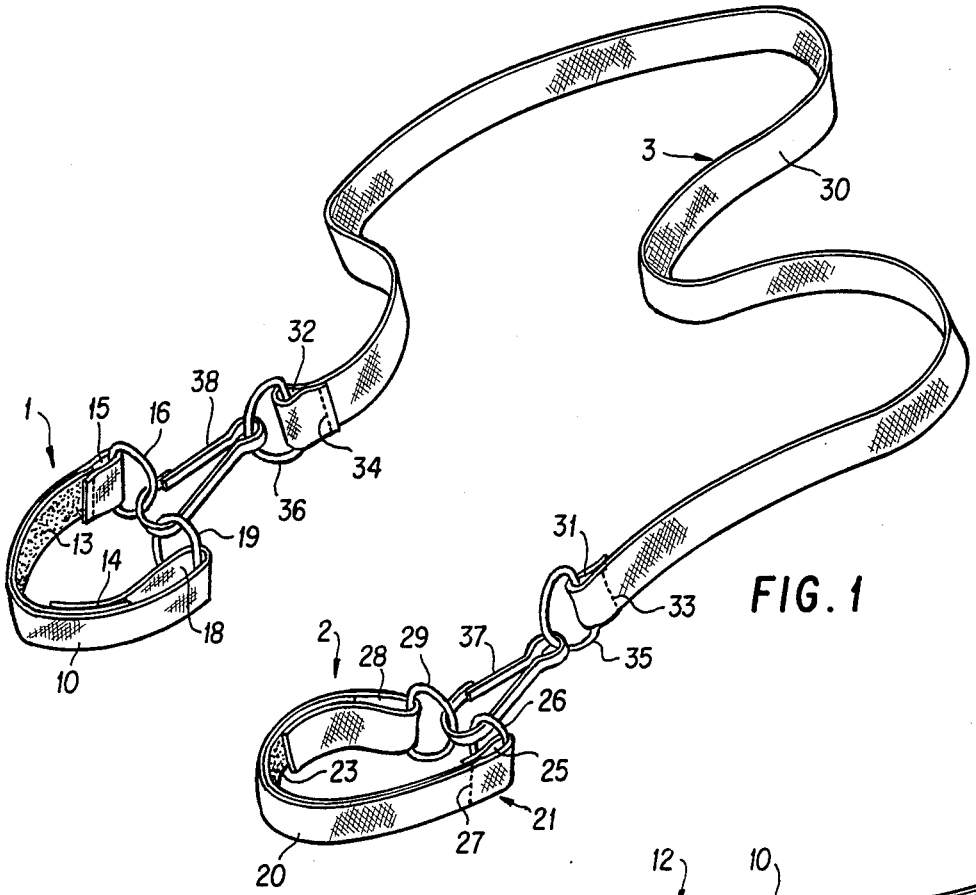
FIG. 1 is a perspective view of the invention in assembled form.
Figure 2:
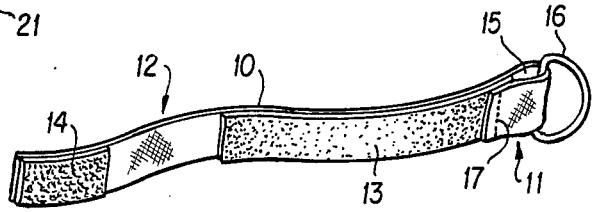
FIG. 2 is a perspective view of the cuff strap of the invention.
Figure 3:
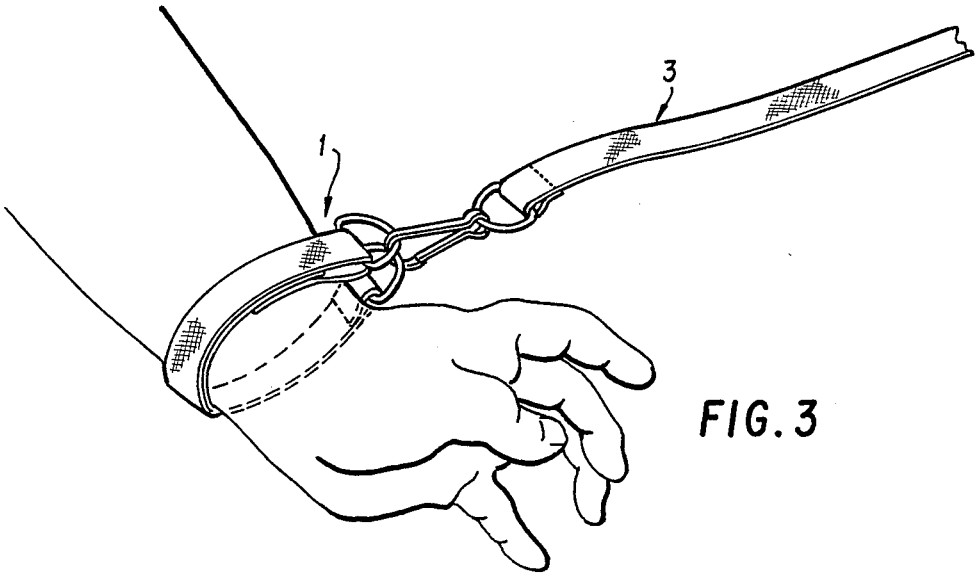
FIG. 3 depicts the cuff assembly in place on a child's wrist.

As seen in FIG. 1, the present invention comprises two wrist cuff assemblies 1 and 2 and an interconnecting strap assembly 3. Referring also to FIG. 2 it will be seen that wrist cuff assemblies 1 and 2 are substantially identical. Therefore the detailed description of a waist cuff assembly will be confined to that of the wrist cuff assembly 1. The wrist cuff assembly comprises a wrist strap and 10 made of extensible material similar to that used in waist bands of skirts and slacks and has two end portions 11 and 12. Affixed to the inner side of the band 10 and extending for approximately ⅔ of the bnd 10 is a strip 13 of loop locking material. It will be noted that strip 13 stops short of the end portion 11 of the strap. The other end portion of 12 of the strap 10 has a tab 14 of pile locking material affixed to the end of it. End portion 11 forms a permanent stretchable loop 15 which holds d-ring 16. The loop 15 is formed by securing the end of end portion 11 to the adjacent end of the strip 13 by means of stitching 17. The strip 13 is stitched to the band 10 and by the stitching removes the extensibility of that portion of band 10. The other end portion 12 of the band 10 forms are adjustable loop 18 which holds d-ring 19. It will be noted that when adjustable loop 18 is formed, strip 14 is in contact with the strip 13 and the outer surface of end portion 12 will then lay against the wrist substantially denying ready access to the strip 14.

The interconnecting strap assembly 3 is comprised of an elongated band 30 of the same materials as the wrists cuffs. Each end of the band 30 is formed with a permanent loop 31 and 32 by means of stitching 33 and 34 after the d-rings 35 and 36 have been inserted. Each d-ring 35 and 36 carries a snap 37 and 38 respectively which engage the d-rings 16 and 19 of cuff assembly 1 and 26 and 29 of cuff assembly 2. The hooks 37 and 38 as seen in the FIG. 1 are the conventional tension type and maybe replaced with hooks having a more complicated and child-proof design. The principle to be followed in selecting the hook, is that preferably the hook should require more pressure to open it than a child could normally accomplish by pinching it between his finger and thumb. At least the effort required by the child should be sufficient that it would be noticed by the adult to whom the child is tethered.

In fitting the wrist cuff to either the adult or the child particularly the child, it is important that the cuff be so adjusted as to be snug on the wrist of the child by not loose enough so that the child can slip its hand through the cuff when it is assembled. To accomplish this, the respective hook is disengaged from the d-rings and the adjustable loop 18 is formed so that the d-rings just meet when the assembly is placed about the child's wrist. There will be sufficient extensibility in loops 18 and 15 so that the hooks may engage the d-rings in completing the positioning of the cuff assembly on the child's wrists. The d-ring may be replaced with rings having a triangular shape or other geometric shape, the principle to be followed is that the rings are completely closed and there is no opening in that part of the hook which is in the fixed loop and the adjustable loop. The extensible material in which the bands, 10, 20, and 30 are made is not only soft and flexible but pliable so that is may be folded into a package that one can hold in a closed hand. But should the device becomes soiled it can be easily cleaned by washing the material as a fabric.

What is claimed:

1. An adult and child tether assembly comprising a pair of wrist cuff assemblies made of an extensible material and a strap assembly for interconnecting the cuff assemblies with cuff assembly engagement means on each end thereof each cuff assembly having a portion thereof of which is not extensible, the interconnecting strap assembly having means on each end to receive and secure each cuff assembly about the wrist of its respective wearer, wherein each cuff assembly has a fixed extensible loop formed on one end and an extensible adjustably positionable loop formed by the other end of that assembly, and further wherein each cuff assembly comprises a band of extensible fabric material, a first band of loop locking material extending $\frac{2}{3}$ of the length of the band of extensible material and secured to said band of extensible material on the interior surface thereof by stitching so as to render a contiguous length of said band inextensible over the length of the loop locking material, the band of loop locking material being so placed on the inner surface of said band of extensible material adjacent one end of said band as to create a short extended length of said extensible material and a long inextensible length of said extensible material, the short end of said extensible material material being secured to the surface of the adjacent end of said loop locking material to form said fixed loop of extensible material, the opposite end of said band of extensible material having secured thereto on the inner surface of said band on the end portion thereof a short band of pile locking material which engages the loop locking material in selectable positions thereon so as to fit the cuff assembly snugly about the wrist of the wearer and simultaneously forming an extensible loop of varying length, said so-formed loop adapted to place said opposite end of said band in contact with the wrist of the wearer and inaccessible when said cuff is placed around said wrist, each cuff assembly further having a d-ring in each of the permanent loop and the extensible loop for engagement with said cuff assembly engagement means.

2. The device according to claim 1 wherein said interconnecting strap assembly comprises a length of said extensible material with said cuff assembly engagement means including a d-ring attached at each end of said strap assembly and a tension hook in each d-ring of said cuff assembly engagement means.

* * * * *